US012722046B2

(12) United States Patent
Husemeyer

(10) Patent No.: US 12,722,046 B2
(45) Date of Patent: Sep. 1, 2026

(54) INFLATABLE BALL CONTAINING ELECTRONIC DEVICES

(71) Applicant: Sportable Technologies Ltd., London (GB)

(72) Inventor: Peter Husemeyer, Tunbridge Wells (GB)

(73) Assignee: Sportable Technologies Ltd., London (GB)

( * ) Notice: Subject to any disclaimer, the term of this patent is extended or adjusted under 35 U.S.C. 154(b) by 0 days.

(21) Appl. No.: 19/389,850

(22) Filed: Nov. 14, 2025

(65) Prior Publication Data

US 2026/0069928 A1 Mar. 12, 2026

Related U.S. Application Data

(63) Continuation of application No. PCT/GB2024/051943, filed on Jul. 23, 2024.

(30) Foreign Application Priority Data

Jul. 28, 2023 (GB) ..... 2311620

(51) Int. Cl.
*A63B 43/00* (2006.01)
*A63B 41/04* (2006.01)

(52) U.S. Cl.
CPC ..... *A63B 43/004* (2013.01); *A63B 41/04* (2013.01); *A63B 43/002* (2013.01); (Continued)

(58) Field of Classification Search
CPC ..... A63B 41/04; A63B 43/002; A63B 43/004; A63B 2220/40; A63B 2220/53; A63B 2220/833; A63B 2243/007
See application file for complete search history.

(56) References Cited

U.S. PATENT DOCUMENTS 4,577,865 A * 3/1986 Shishido ..... A63B 43/00 473/570
9,517,389 B2 * 12/2016 Won ..... A63B 43/06
(Continued)

FOREIGN PATENT DOCUMENTS

GB 2591216 7/2021

OTHER PUBLICATIONS

International Search Report and Written Opinion for PCT/GB2024/051943 dated Oct. 22, 2024.

*Primary Examiner* — Audrey B. Walter
(74) *Attorney, Agent, or Firm* — Godfrey & Kahn, S.C.; Christopher M. Scherer

(57) ABSTRACT

An inflatable ball with integrated electronics and a method of manufacture. The inflatable ball comprises a bladder defining an inflatable interior of the ball and an electronics casing attached to, or integrally formed with, the bladder. The electronics casing defines a compartment adjacent an inner surface of the inflatable interior of the ball and sealed within the inflatable interior of the ball. The inflatable ball further comprises at least one electronic component, wherein the electronic component is located within the compartment of the electronics casing; and wherein the compartment is in fluid communication with the inflatable interior of the ball such that the compartment is at the same pressure as the inflatable interior of the ball.

10 Claims, 8 Drawing Sheets

(52) U.S. Cl.
CPC ..... *A63B 2220/40* (2013.01); *A63B 2220/53* (2013.01); *A63B 2220/833* (2013.01); *A63B 2243/007* (2013.01)

(56) References Cited

U.S. PATENT DOCUMENTS

| | | | | |
|---|---|---|---|---|
| 9,586,099 | B2 | 3/2017 | Holthouse | |
| 11,511,164 | B2 * | 11/2022 | Francis | A63B 41/08 |
| 2004/0162170 | A1 * | 8/2004 | Ng | A63B 41/00 473/571 |
| 2014/0274498 | A1 | 9/2014 | Berggren | |
| 2016/0074714 | A1 * | 3/2016 | Krysiak | A63B 43/004 473/570 |
| 2017/0028265 | A1 | 2/2017 | Krysiak et al. | |
| 2017/0319910 | A1 | 11/2017 | Kroken | |
| 2021/0138308 | A1 | 5/2021 | San Juan | |

* cited by examiner

INFLATABLE BALL CONTAINING ELECTRONIC DEVICES

CROSS-REFERENCE TO RELATED APPLICATIONS

The present application is continuation of International Application No. PCT/GB2024/051943 filed Jul. 23, 2024 which application was published on Feb. 6, 2025, as WO2025/027284, and further claims priority to GB Application No. 2311620.5 filed Jul. 28, 2023, the contents of which are incorporated herein by reference in their entireties.

FIELD OF THE INVENTION

This application relates to an inflatable ball containing electronic components and a method of manufacture of said inflatable ball.

BACKGROUND

Sports data and the way in which we view and use it has changed rapidly over the last decade. Historically, sports data collection and usage were non-existent or anecdotal. However, data collection and usage has become a vital part of modern-day sports and are only likely to increase in importance.

Data collection in sports is beneficial for many reasons. Firstly, data collection is valuable for training, as it allows the athletes to gain a better knowledge of their performance and key statistics. For example, the total distance covered in a match by a certain player may be a useful indicator of their fitness and level of participation. Secondly, statistics and data figures have become an increasingly important aspect of the viewer experience during sporting events. Tennis and golf have used sensors and trackers external to the ball for a while now, and more recently internal sensors and trackers have been used in sports like American football. Such ball trackers allow spectators to see statistics such as speed, distance, number of passes, or the force exerted by an athlete during kicking, for example.

When a sensor or tracker has been placed inside of an inflatable sports ball, one approach has been to use a "pocket", often formed from folds and sections of the bladder itself, to hold the electronic components. However, a problem with these designs is that the high pressure inside of the ball can press against the electronics in the pocket and deform the pocket or urge the electronics out of the pocket. This can damage or impede the ability of the electronic components to function properly. The high pressure inside of the ball pressing against the pocket may create a bulge or deformity on the outer surface of the ball. Furthermore, as the electronic components in such a design are not at the same pressure as the inside of the ball they cannot measure the internal pressure of the ball.

On the other hand, the electronic components can be placed within the bladder itself and held in position via attachments to the inside of the bladder. This is usually the method used when it is desired to place the electronics close to the centre of the ball for better balancing. However, placing the electronics inside the bladder is often difficult from a manufacturing perspective, as the design is complicated and requires an involved process of attaching the electronics inside the bladder.

There is therefore a need for an inflatable ball that can be readily manufactured and in which the electronic components can be securely and reliably, incorporated into the ball.

SUMMARY OF INVENTION

According to a first aspect of the invention, an inflatable ball with integrated electronics is provided. The inflatable ball comprises: a bladder defining an inflatable interior of the ball; an electronics casing attached to, or integrally formed with, the bladder, the electronics casing defining a compartment adjacent an inner surface of the inflatable interior of the ball and sealed within the inflatable interior of the ball; and at least one electronic component, wherein the electronic component is located within the compartment of the electronics casing; and wherein the compartment is in fluid communication with the inflatable interior of the ball such that the compartment is at the same pressure as the inflatable interior of the ball.

A bladder may be used to describe any component which provides an inflatable ball with its general shape and rigidity once inflated. A bladder may be elastic and may be made of rubber or any other elastic polymer, or non-elastic and made of a stiff polymer, for example. The bladder, once fully attached or integrally formed with any components which are necessary to make it substantially airtight, defines an inflatable interior of the ball allowing for inflation of the inflatable ball to a substantially rigid form.

An inner surface of the inflatable interior of the ball can be defined as the surface of the inflatable interior of the ball which faces towards the centre of the ball. As mentioned above, the inflatable interior of the ball is defined primarily by the bladder, but may also be partially defined by other components that contribute to forming the entire airtight membrane surrounding the inflatable interior of the ball. The inner surface of the bladder may face towards itself and therefore can define a mostly concave shape.

A bladder is usually encased in a layer of material which forms an outer surface of an inflatable ball, which is often the case for traditional footballs and rugby balls. However, the bladder itself may form the outermost layer of the inflatable ball, as is often the case with beach balls, for example. The bladder may also have additional layers between itself and an outer layer. Any outermost layer may be used with the presently-described bladder.

A bladder will usually form a generally spherical, spheroid or ellipsoid shape when inflated. However, any shape which is required for the inflatable ball may be provided by an inflatable bladder.

The electronics casing may be any structure or component which can at least partially define a compartment which can encapsulate, cover, wrap, restrict, limit, constrain, and/or support one or more electronic components.

Preferably, the electronics casing substantially surrounds the one or more electronic components in all directions facing the inflatable interior of the ball. The electronic components will be understood to be substantially surrounded in all directions facing the inflatable interior of the ball when all openings through the electronics casing to the inflatable interior of the ball are smaller than the one or more electronic components. Preferably each opening through the electronics casing to the inflatable interior of the ball will have an area that is at most 80%, or at most 50%, or at most 25%, or at most 10%, of the projected area of the electronic component, projected along a direction perpendicular to said opening. These openings that are smaller than the one or more electronic components generally serve the purpose of ensuring the compartment is in fluid communication with the inflatable interior of the ball, and are generally referred to as perforations in the present disclosure.

Preferably, the electronics casing is made of the same material as the bladder. Alternatively, the electronics casing may be made of a material having a Young's modulus not more than 50%, or 20%, or 10%, higher than the Young's modulus of the material forming the bladder, preferably equal to or lower than the Young's modulus of the material forming the bladder. In this way, the electronics casing material has the same, or similar, elastic properties and/or deformation properties to the material of the bladder. This allows for the electronics casing to deform and change shape by the same amount as the bladder when the ball is inflated or deflated, or when it changes shape during use such as when it is kicked. This reduces the stress at the interface between the electronics casing and the bladder due to their equal strain at the material interfaces, as they are attached to one another and therefore must change shape together. Therefore, as the stress at the interface between the electronics casing and the bladder is reduced, the reliability and structural integrity of the interface is improved. Furthermore, this means that the electronics casing does not cause any bulging, or other such deformities, in the shape of the ball when the ball is inflated or deflated, or during any other change in the shape of the ball during use.

It will be understood that adjacent, when describing the placement of the compartment in relation to the inner surface of the inflatable interior of the ball, can be understood to mean that it is substantially next to, adjoining, continuous, joined with, or otherwise connected to the inner surface of the inflatable interior of the ball. Therefore, the compartment is located substantially on the periphery of the inflatable ball, and away from the centre of the inflatable ball.

It will be appreciated that an electronic component can take many forms, and may include one or more of: accelerometers, charging components, wiring, batteries, transceivers, receivers, processors, memory components, lighting elements, sound emitting devices, stress sensors, force sensors, pressure sensors, or any other such device. The inflatable ball may be equipped with such electronic components that are necessary to measure data, receive data, or send data as may be required. For example, the inflatable ball may be equipped with an accelerometer, processor, battery, charging device, and transmitter so that it can be used in a rugby match to detect movement and transmit the data to an external receiver.

In a preferable implementation, the one or more electronic components comprise one or more electromechanical components, preferably one or more micro-electromechanical systems (MEMS). Preferably, the one or more electronic components comprise sensors. Examples of electromechanical sensors include accelerometers, gyroscopes, force sensors, pressure sensors, which may be used to monitor the status of the ball.

In some embodiments, the one or more electronic components comprise one or more of an integrated circuit, a battery, a processor, a memory chip or a wireless communication device.

As used in this application, the compartment being in fluid communication with the inflatable interior of the ball means that fluids can substantially freely move from the inflatable interior to the compartment so that, substantially instantaneously after inflation of the ball, the compartment and inflatable interior are at the same pressure. Fluid in this application has its usual definition, that of a material which continuously deforms under an applied shear stress/external force. An example of a fluid would be water or air. As will be understood, most implementations of the inflatable ball will use air or other common gasses as the fluid, however the invention is not limited to this.

As the compartment and inflatable interior of the ball are in fluid communication, air, for example, is able to move between the two without significant resistance, allowing the air pressure to equalise in either component if one is inflated or deflated.

Advantageously, by allowing the compartment to be in fluid communication with the inflatable interior of the ball it prevents the high pressure inside of the inflatable interior of the ball from pressing against the electronics in the compartment and deforming the compartment or urging the electronics out of the compartment. Therefore, damage or impedance in the ability of the at least one electronic component to function properly is minimised or eliminated.

As well as this, by having the compartment and inflatable interior of the ball at the same pressure, it reduces any bulging, or other such deformity, to the outside of the inflatable ball from any electronics casing, or component, being pressed against the bladder, or any outer layer, due to a pressure differential. Therefore, the inflatable ball can maintain its desired shape and characteristics.

Furthermore, having the compartment and inflatable interior of the ball at the same pressure allows the at least one electrical component to measure the pressure of the inflatable interior of the ball if required.

Preferably, the electronics casing defines an opening into the compartment for inserting the at least one electronic component. An opening as used in this application can be understood to mean a hole, slot, or other such gap the casing sufficiently large to allow for the one or more electronic component to pass through. Such an opening allows for the easy placement and orientation of the at least one electronic component within the inflatable ball. As will be described in more detail below, this opening may be closed by another component in the final inflatable ball.

In a preferable implementation, the opening faces an exterior of the bladder and is sealed by a sealing member or by the inner surface of the bladder. An exterior of the bladder can be understood to mean the surface of the bladder outside of the inflatable interior. For example, the exterior of the bladder may be the surface of the bladder mostly not facing itself. Broadly, therefore, the outside of the blader defines a substantially convex shape. It will be appreciated that the opening facing the exterior of the bladder refers to the opening substantially directly facing the exterior of the bladder, i.e. facing generally away from the centre of the inflatable interior of the ball.

Preferably, the opening into the compartment for inserting the at least one electronic component is sealed such that it does not allow for fluid communication out of the electronics compartment.

It will be understood that sealed, as used in this application, can be defined as being provided with an air-tight closing, attachment, or other such joining. Preferably, the sealing member is an airtight layer extending over the opening and sealed to the bladder or electronics casing. Airtight as used in this application has its usual meaning; that of being impermeable to air or other gases, and consequently to other fluids. Therefore, airtight is not limited to air alone, and can be used to indicate that water flow is not possible either, for example.

A sealing member allows the inflatable ball to remain airtight, as a whole, once the opening is sealed, but allows for the advantages in manufacture that come from having an opening facing the exterior of the bladder.

Preferably, prior to sealing, the opening opens through to an exterior side of the bladder, such that the at least one electronic component may be inserted into the compartment from an exterior of the bladder. Having the opening open to an exterior side of the bladder allows for the electronics to be inserted into the inflatable ball with ease. This allows for the manufacturing and assembly process to be simplified as the bladder can be constructed before the electronic components are inserted, for example. Therefore, the bladder does not need to be constructed around the electronic components. Once the bladder is manufactured and the electronic component inserted from the outside of the bladder, the opening may then be sealed by a sealing member, as described above, to form the airtight inflatable interior of the ball with the electronic component sealed inside the ball and in fluid communication with the interior of the ball.

In a possible implementation, the electronics casing is formed as one integral piece. One integral piece can be understood to mean made out of a single piece of material e.g. formed in one forming or moulding step. In alternative embodiments, the electronics casing may be formed of several pieces of material joined to create a structure which functions as one piece. Once again, this simplifies the manufacture and assembly of the inflatable ball.

Preferably, the electronics casing defines the compartment by a substantially concave portion of the electronics casing. Substantially concave meaning that the electronics casing recesses inwardly, in such a way that it creates a space which can define the compartment. This is a convenient way to define a recessed space in which the electronic component may be housed adjacent to the inner surface of the inflatable interior of the ball. This concave portion of the electronics casing preferably faces the exterior of the bladder, so that the opening into the concavity may define the opening, referred to above, through which the electronic component may be inserted from the exterior of the bladder into the compartment.

Preferably the concave portion of the electronics casing faces the exterior of the bladder, so that the opening into the concavity may define the opening, referred to above, through which the electronic component may be inserted before the casing is inserted into the bladder. The periphery of the opening can then be attached to the inside of the balder such that the bladder can seal the opening of the casing.

Preferably, a shock absorbing layer is located in the compartment between the electronic component and an exterior of the bladder. A shock absorbing layer being any material with natural, or designed, properties that allow it to dampen and absorb energy after an impulse. The exterior of the bladder referenced above is the portion of the exterior surface of the bladder closest to the at least one electronic component. In other words, the electronic component may be located between the shock absorbing layer and the centre of the inflatable interior of the ball.

The shock absorbing layer provides protection to the electronic components while the inflatable ball is in use. For example, when being hit or kicked the ball experiences great levels of forces as well as when the ball lands or is hit or kicked again. The shock absorbing layer reduces the magnitude of the force experienced by the electronic components within the inflatable ball. As a sudden force being imparted on the inflatable ball will most likely be from the direction of the exterior of the inflatable ball, and therefore the bladder as well, the shock absorbing layer is placed between the electronic component and an exterior of the bladder.

Preferably, the shock absorbing layer at least partially surrounds the at least one electronic component on two or more sides, wherein preferably the shock absorbing layer substantially surrounds the at least one electrical component on all but one side, and the side of the electronics not surrounded by the shock absorbing layer faces towards a centre of the inflatable interior defined by the bladder. It may be understood that the centre of the inflatable interior may be the geometric centre of the sports ball, or the centre of mass, or both, for example.

In a further preferable implementation, the shock absorbing layer surrounds the majority of the at least one electronic component. These preferably implementations of the invention increase the amount of protection that the shock absorbing layer provides to the electronic components within the inflatable ball.

A shock absorbing layer may not be necessary if the electronic component is not sensitive to such forces or if the electronic casing can act as a shock absorbing member itself.

Preferably, the electronics casing is fixed relative to the bladder. Fixed meaning the electronics casing is attached or otherwise held in place relative to the bladder. For example, the casing may be bounded, stitched, glued, welded, sealed, integrally formed with, or otherwise connected to the bladder. Having the electronics casing fixed relative to the bladder allows for the position and orientation of the casing to be kept constant while the inflatable ball is in use.

Preferably, the at least one electronic component is fixedly attached to the electronics casing. Having the at least one electronics component fixed relative to the electronics casing allows for the position and orientation of the components to be kept constant while the inflatable ball is in use. In other embodiments, the electronic component may be held in place by the shock absorbing material in the compartment.

Preferably, the ball may be an American football, a rugby ball, a soccer ball or a basketball. Any sport ball that requires inflation would benefit from the claimed invention, even if not explicitly referenced above; for example, a beach volleyball. Non-sports inflatable balls may benefit from the invention; for example, an inflatable weather balloon with electronic components.

In a preferable implementation, the electronics casing comprises one or more perforations through the electronics casing so that the compartment of the casing is in fluid communication with the inflatable interior of the ball. A perforation may be understood to be an opening, slot, piercing, or other such small hole. Small, as used to define the perforation, is relative to the electronic components. Therefore, while such a perforation allows for fluid communication between the compartment and the inflatable interior of the ball, preferably it does not allow electronic components to be readily moved through them. Through the casing, as used to define the perforation, may be understood to mean that the perforation is a through hole extending between the compartment in the casing and the inflatable interior such that fluid communication is allowed. The perforation does not have to be perpendicular to a surface of the casing. Other methods for allowing fluid communication are possible, for example by incorporating a section of air porous material or a specific two-way valve or flap. While such methods are not discussed further in the application, the application is not limited to perforations.

In a further preferable implementation, the perforations are small enough such that when the ball is in use, and is kicked or thrown for example, the electronic components do not escape from the electronics casing, but are large enough that the fluid communication between the inside of the bladder and the inside of the electronics component has minimal resistance.

Preferably, the perforations and the opening of the electronics casing for inserting the at least one electronic component are separate.

Preferably, the electronics casing substantially encloses the at least one electronic component located in the compartment. This allows the electronic component to be securely held in place inside the compartment. In a preferable implementation, the at least one electronic component includes at least one accelerometer. An accelerometer being a sensor which is configured to measure an acceleration directly, or a force which can then be converted into an acceleration measurement.

In a preferable implementation, the at least one electronic component comprises a wireless charger. A wireless charger being an electronic component, or components, which are configured to allow a battery to be charged via a charging process that does not comprise the insertion of a connectable charging wire. Preferably, the at least one electronic component comprises a battery connected to the wireless charger.

Preferably, the bladder contains an opening for receiving the electronics casing, the electronics casing being attached to the bladder about the periphery of said opening. This allows the electronics casing to be inserted into the bladder and attached to the bladder during manufacture. The electronics casing should be attached to the bladder about the periphery of said opening, preferably sealed about the periphery of the opening, so that air cannot pass between the electronics casing and the bladder. For example, the casing may comprise a flange which engages with a surface of the bladder and which is attached or sealed to the bladder around the opening through the bladder.

In another preferable implementation, the electronics casing is attached to an inner surface of the bladder. This may be preferred when the bladder is a conventional bladder without an opening for the electronics casing and the electronics casing is being mounted to an inner surface of the bladder from an inside of the interior of the ball.

Preferably, when the electronics casing is attached to an inner surface of the bladder this is achieved via attaching the electronic casing such that the opening of the electronics casing (for inserting the at least one electronic component) faces the inner surface of the bladder, preferably being attached along or about the opening. For example, the electronics casing may comprise one or more flanges about the opening of the electronics casing, and the electronics casing may be attached to the inner surface of the bladder via these one or more flanges.

The benefits of attaching the electronics casing to the inner surface in this way is that it allows for a conventional, and substantially unmodified, bladder to be used. Furthermore, the bladder then provides a closing member to close the opening of the electronics casing, thereby preventing the electronic device from moving outside of the electronics casing once the ball is assembled. The opening being the previously mentioned opening which allows for the electronic components to be inserted into the electronics casing during assembly.

Preferably, the bladder further comprises an air valve for inflating the ball, the air valve being located substantially opposite to the electronics casing. An air valve may be a substantially one-way valve allowing for the inflatable ball to be inflated. Placing the electronics casing opposite the valve allows for consistent and accurate placement and may also allow for better balancing of the ball, as the weight of the electronic component may be offset by the valve. Furthermore, it provides a kicker knowledge of exactly where the electronics are so that they may be avoided. Similarly, such a relative position of the valve and electronics allows for wireless charging to be accurately performed as the location of the electronic components, and any wireless charging components, to be easily located.

In a further implementation, the air valve for inflating the ball is not positioned substantially opposite the electronics casing but is still positioned such that it is distinct and separate from the electronics casing. Preferably, the air valve is not in contact with, or immediately adjacent to, the electronics casing. For example, preferably the valve is separated from the electronics casing by an area of bladder wall.

According to a second aspect of the invention, there is provided a method of manufacturing an inflatable ball, the method comprising the steps of: providing a bladder which defines an inflatable interior of the ball; providing an electronics casing attached to, or integrally formed with, the bladder wherein the electronics casing defines a compartment adjacent an inner surface of the inflatable interior of the ball and sealed within the inflatable interior of the ball; and arranging at least one electronic component to be located within the compartment of the electronics casing; and wherein the compartment is in fluid communication with the inflatable interior of the ball such that the compartment is at the same pressure as the inflatable interior of the ball.

The method according to the first aspect of the invention corresponds to a method of manufacturing an inflatable ball according to the first aspect of the invention. Accordingly, the above comments apply equally to this second aspect of the invention.

In particular, preferably, the step of arranging at least one electronic component to be located within the compartment of the electronics casing further comprises the at least one electronic component being inserted into the electronics casing through an opening provided by the electronics casing. Further preferably, the opening, used in the step of inserting the at least one electronic component into the electronics casing, faces an exterior of the bladder, and the method then comprises sealing the opening by a sealing member or by the inner surface of the bladder. Preferably, prior to the sealing step, the opening opens through to an exterior side of the bladder, such that the step of inserting the at least one electronic component into the electronics casing comprises inserting the at least one electronic component into the electronics casing from an exterior of the bladder.

BRIEF DESCRIPTION OF DRAWINGS

Embodiments of the invention will now be described with reference to the figures, in which.

DETAILED DESCRIPTION

The present disclosure relates to an inflatable ball with integrated electronics and a method of manufacture of the inflatable ball.

The numerals used in the figures relate to the following features: 10, bladder; 20, electronic casing; 30, electronic component; 40, shock absorbing layer; 50, sealing member; 60, perforations; 70, electronic casing opening; 80, compartment; 90, inner surface of the bladder; 100, inflatable interior; 110, valve; 120, bladder hole; 130, electronic casing flange; 140, upper surface of the flange; 150, bottom surface of the flange; 160, outside surface of the bladder; 170, electronics casing base; 180, electronics casing base bottom; 1000, first embodiment; 2000, second embodiment; and 3000, third embodiment.

First Embodiment

Figure 1:
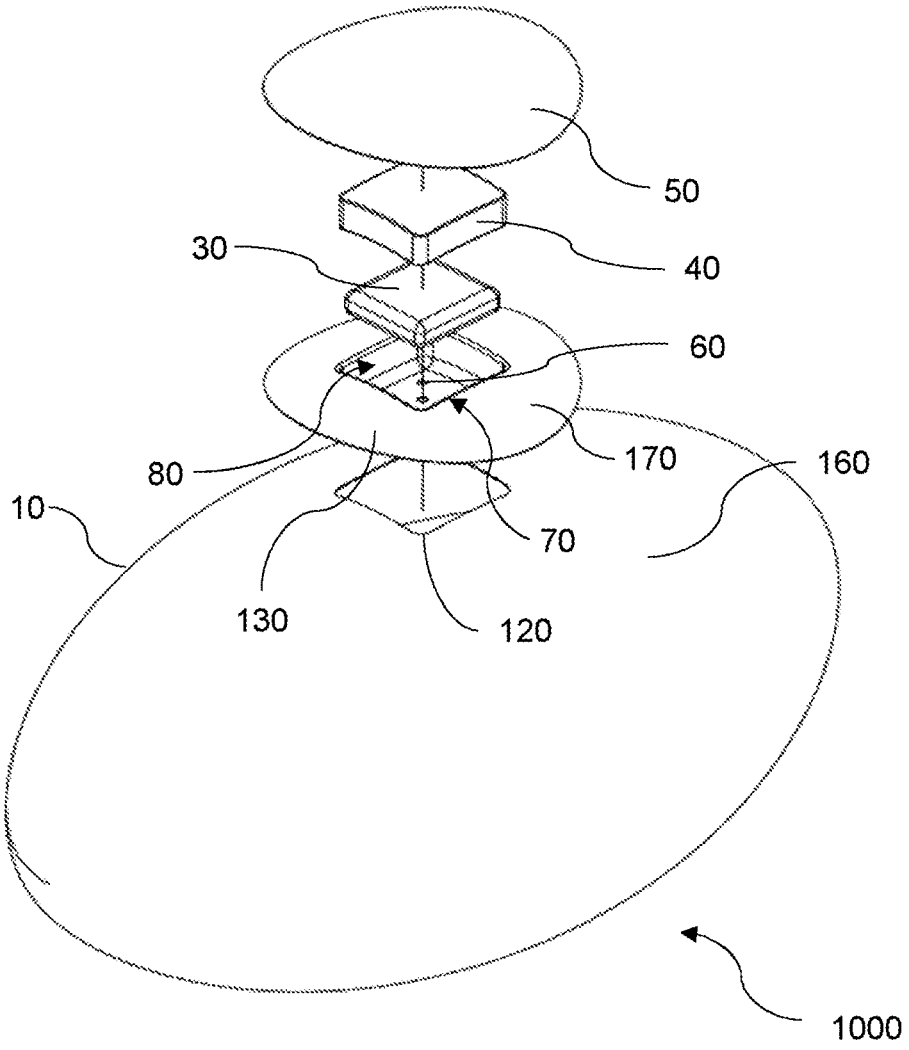
FIG. 1 shows an overview of the first embodiment of the invention where the electronics casing base is formed separately to the bladder and the bladder comprises a hole.
Figure 2:
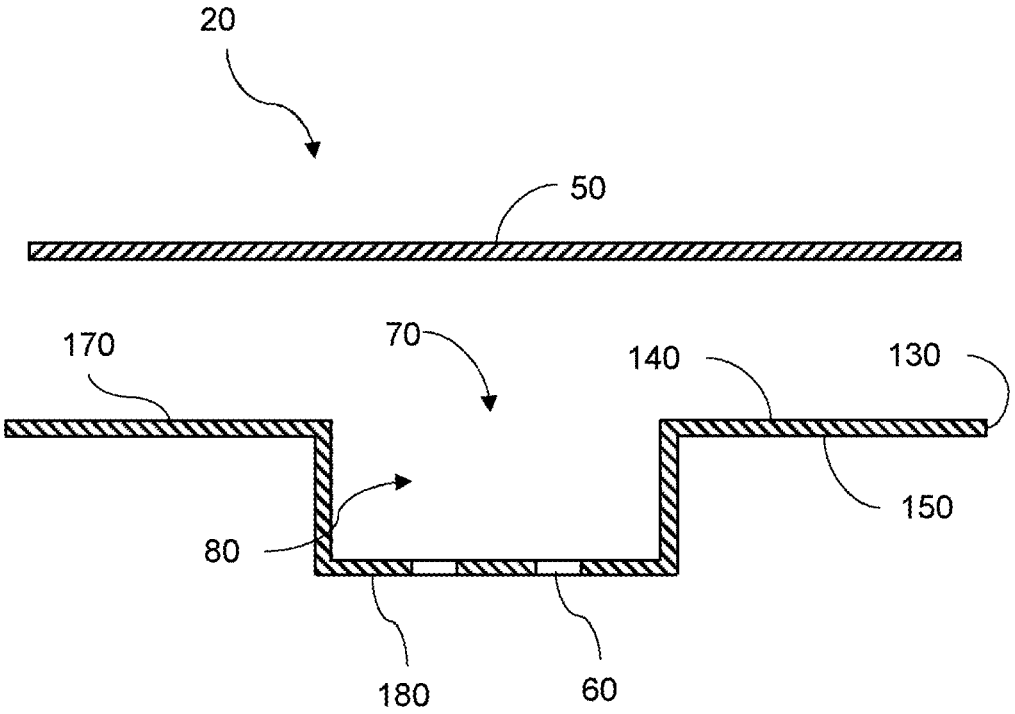
FIG. 2 depicts an example electronics casing including a sealing member.
Figure 3:
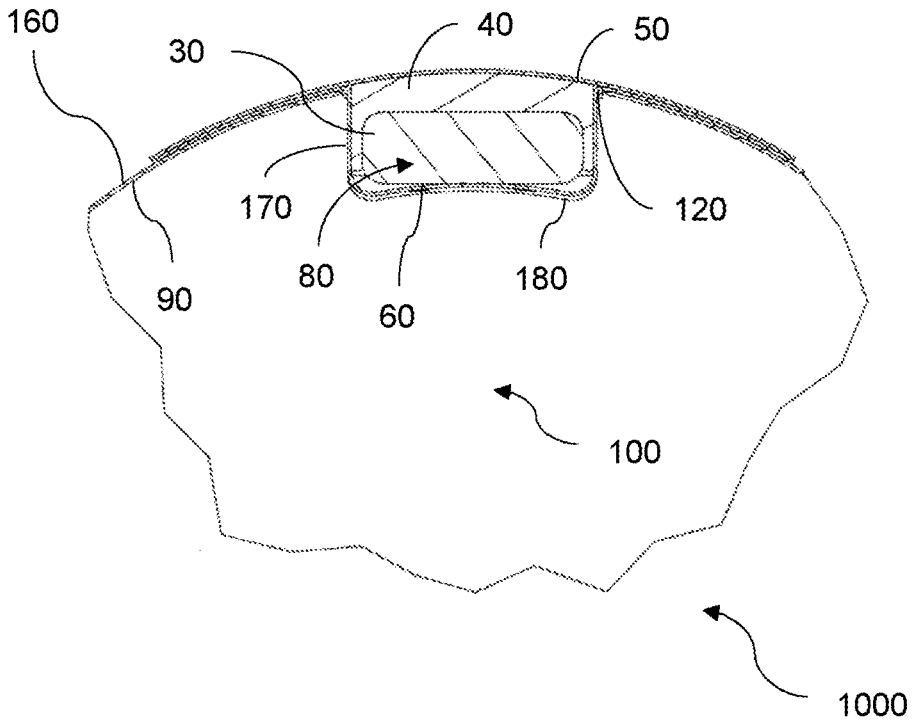
FIG. 3 shows a cut through section of the first embodiment.

FIGS. 1 to 3 depict a first embodiment 1000 of the present invention. FIG. 1 depicts an overall image of the first embodiment with the components in an exploded view. FIG. 1 shows an inflatable ball comprising, as its main elements, a bladder 10, an electronics casing 20 attached to the bladder, and an electronic component 30 located in the electronics casing.

As can be seen, the electronics casing 20 includes an electronics casing base 170 and sealing member 50. The electronics casing base 170 has a recessed or concave compartment 80 with a substantially square footprint. The compartment 80 is recessed with respect to a circular flange portion 130 of the electronics casing base 170. The compartment 80 defined by the electronics casing 20 has at least one electronic component 30 and a shock absorbing layer located inside.

The bladder, as is usual in an inflatable ball, defines the inflatable interior 100 of the ball, which can more easily be seen in FIG. 3. The bladder and electronic casing are attached to one another in such a manner as to create an airtight inflatable ball.

This first embodiment is characterised in that the electronics casing 20 and the bladder 10 are not integrally formed, and rather the bladder contains a hole 120 for receiving the electronics casing 20. The bladder hole 120 allows the electronics casing 20 to define a compartment 80 recessed inside the inflatable interior 100 of the bladder while the electronics casing can be attached to the outside surface of the bladder 160. This embodiment provides the electronics casing and bladder as separate components which are attached together so that the design and manufacture of the bladder is greatly simplified. This embodiment allows for a simpler manufacture and assembly as the bladder does not have to be constructed in such a way as to include the electronics casing already.

As mentioned above, the electronics casing has an outer flange 130, which sits on the outside surface of the bladder 160 so that the two overlap one another when the compartment 80 of the casing is inserted through the opening. This allows for a secure and airtight attachment of the bladder and electronics casing to be provided between the flange 140 and the bladder 10. Numerous attachment methods may be used, such as: adhesives, polymer welding, stitching, or any combination of the aforementioned methods, for example. The join between the casing 20 and the bladder should be made airtight, if this is not already achieved by the attachment method.

FIG. 2 depicts an electronics casing as used in the first embodiment, wherein the electronics casing is formed of an electronics casing base 170 and a sealing member 50. As can be seen, FIG. 2 provides a simplified schematic which portrays general relationships between components and features, and does not prescribe specific geometries or relative sizes.

In the first embodiment, both the electronics casing base 170 and sealing member 50 are separate to the bladder and are either directly or indirectly attached to the bladder to form an airtight inflatable ball.

As is discussed below, in the second embodiment the electronics casing base 170 is integrally formed with the bladder 20 so that it does not need to be attached, while the sealing member 50 is still separate and does need to be attached to the bladder 10 to create an airtight inflatable ball. Therefore, FIG. 2 is also relevant to the second embodiment.

As is also discussed below, in the third embodiment, the electronics casing base 170 is attached directly to the inner surface of the bladder 90 so that a sealing member 50, as is used in the first and second embodiment, is not required. FIG. 2 is still relevant to the third embodiment as the electronics casing base 170 is still present and the sealing member 50 is merely replaced by the inner surface of the bladder 90.

Therefore, as can be understood from the discussion above in relation to FIG. 2, the electronics casing can be understood to refer to independent components such as the electronics casing base 170 and sealing member 50, an integrated electronics casing base 170 and separate sealing member 50, or an electronics casing base 170 alone. Therefore, generally, the electronics casing 20 can be understood to be any component which defines a compartment for the one or more electronics components. Thus, the electronics casing 20 is not necessarily limited to an integrated electronics casing base 170 and sealing member 50 as depicted in FIG. 2, or any other Figure or example embodiment provided.

FIG. 1 depicts the order of the layering of the bladder 10 and electronics casing 20 as is used in the first embodiment. As can be see, the electronics casing compartment 80 can be lowered into the bladder hole 120 and the bottom surface of the electronics casing flange 140 overlaps the outer surface 160 of the bladder. The electronic component 30 may then be dropped into the compartment of the electronics casing, which is now recessed into the bladder surface, from the exterior side of the bladder. A layer of shock absorbing material 40 is then placed over the electronic component, which will be discussed in more detail below. The sealing member 50, in this case an airtight layer, is then attached to the upper surface of the flange 140 such that an airtight seal is created. This leads to an inflatable interior of the ball which can be inflated. It should be noted that the electronic component 30 could alternatively be placed in the compartment 80 of the electronics casing, the shock absorbing layer added, and the sealing member 50 sealed to the upper surface of the flange 140 before the whole electronics casing is inserted into the bladder hole 120 and the casing sealed around the bladder hole 120.

The bottom of the electronics case base 180 preferably contains perforations 60 such that the compartment 80 is in fluid communication with the inflatable interior of the ball once the casing is inserted into the opening through the bladder. As the compartment 80 and the inflatable interior of the ball 100 are in fluid communication they are at the same pressure. However, as the sealing member 50 creates an airtight seal over the compartment, the inflatable ball remains airtight.

Therefore, a compartment, for at least one electronic component, in an inflatable ball is at the same pressure as the inflatable interior of the ball while still providing a ball which can be inflated.

FIG. 3 depicts a cut through of a section of the inflatable ball as described in the first example embodiment so that it can be seen how the components are attached relative to one another once assembled.

As can be seen, an electronics casing 20 is attached to the bladder 10, the electronics casing 20 further defining a compartment 80 adjacent an inner surface of the inflatable interior of the ball and sealed within the inflatable interior of the ball. The compartment thus sits recessed with respect to the bladder 10.

In the first embodiment, the compartment 80 is adjacent to the inner surface of the inflatable interior in the sense that the electronic casing 20, which defines the compartment 80, is physically attached to the bladder 20 so that the compartment 80 is recessed into the inflatable interior 100 of the ball. Specifically, the compartment 80 is within the inflatable interior 100 of the ball while still being attached to the bladder 10.

As can be seen in FIG. 3, the electronics casing flange 130, specifically the bottom surface of the flange 150, is attached to the outer surface of the bladder 160 while the base of the electronics casing protrudes through the bladder hole 120 such that the compartment 80, defined by the base of the electronics casing 170 and the sealing member 50, is within the inflatable interior of the ball 100.

An additional preferable feature of the first embodiment is the addition of a shock absorbing layer 40 between the at least one electronic component 30 and the outside of the inflatable ball. The shock absorbing layer may be a layer of foam padding, for example.

The shock absorbing layer 40 provides protection to the at least one electronic component 30 while the inflatable ball is in use. For example, when being hit or kicked, the ball experiences great levels of forces during the action as well as when the ball lands or is hit or kicked again. The shock absorbing layer 40 reduces the magnitude of the force experienced by the at least one electronic component 30 within the inflatable ball. As the greatest sudden force which may be imparted on the inflatable ball will likely be from the direction of the exterior of the inflatable ball, and therefore the bladder as well, the shock absorbing layer is placed between the electronic component and an exterior of the bladder.

The shock absorbing layer 40 substantially surrounds the at least one electronic component 30 on all but one side, and the side of the electronics 30 not surrounded by the shock absorbing layer 40 faces towards a centre of the inflatable interior 100 defined by the bladder 20.

As is clear from the above, in this embodiment, the electronics casing is fixed relative to the bladder and therefore cannot move relative to it once attached. The electronic component 30 may be fixed to the compartment 80, e.g. by an adhesive, or as shown in this embodiment may be restrained by the shock absorbing material so that it is securely held while the inflatable ball while it is in use.

Figure 4:
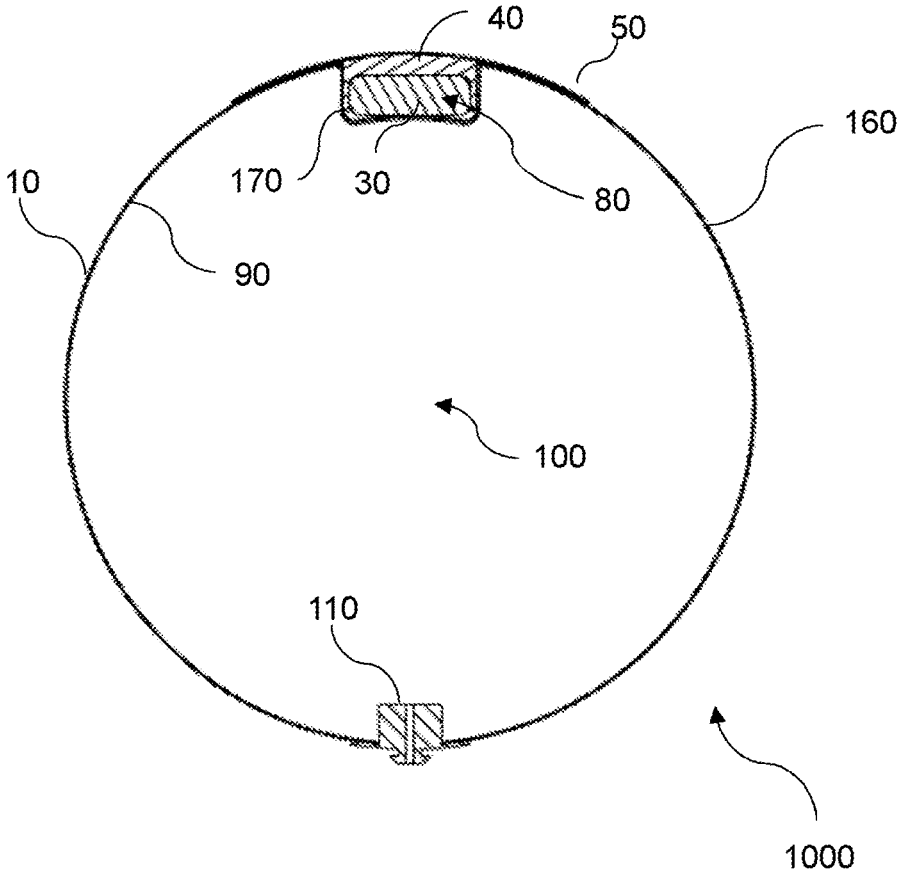
FIG. 4 shows a larger cut through of the first embodiment.

FIG. 4 depicts a cut through image of a modification to the inflatable ball of the first embodiment, in which the bladder is spherical rather than a prolate spheroid, but is otherwise identical.

FIG. 4 depicts an example embodiment wherein the valve is positioned opposite the electronic components and casing to offset the weight of the electronics casing and electronics component.

The above embodiment, and in fact any of the other two described below, are suitable for inflatable balls to be used as a rugby ball, an American football, or a soccer ball, for example.

Second Embodiment

Figure 5:
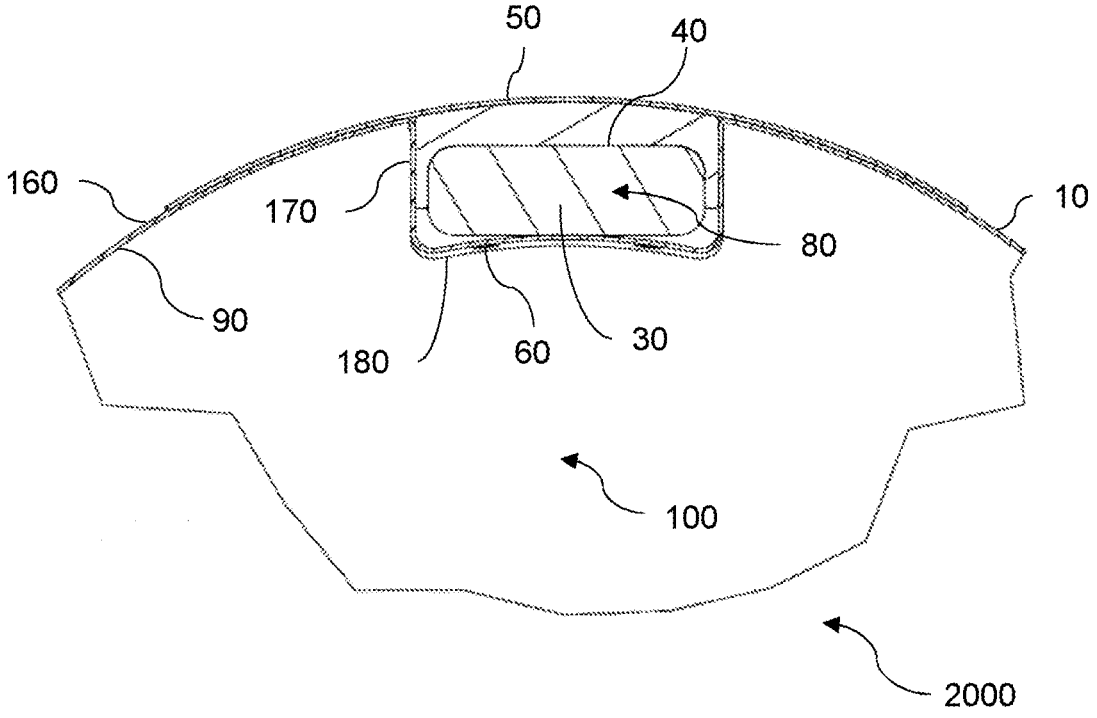
FIG. 5 shows a cut through section of the second embodiment of the invention where the electronics casing is integrally formed with the bladder.
Figure 6:
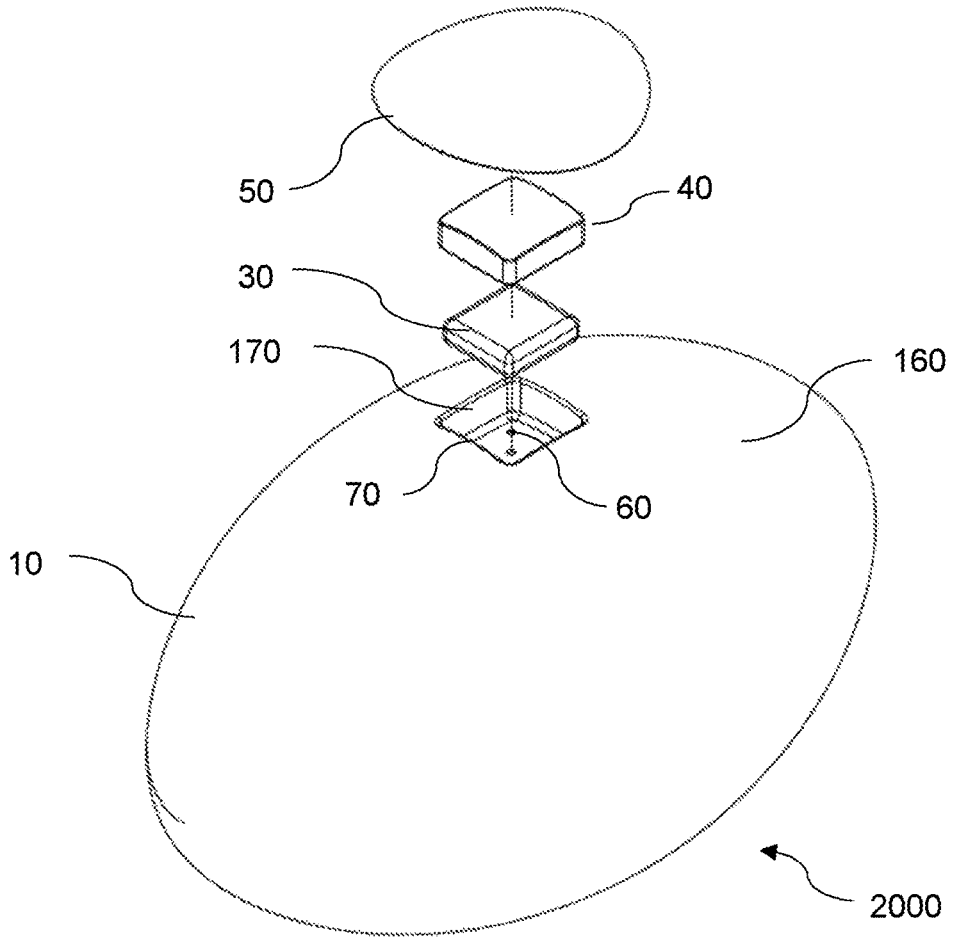
FIG. 6 shows an overview of the second embodiment.

FIGS. 5 and 6 depict a second example embodiment of the invention. In this embodiment of the invention the electronics casing base 170 is provided by an integral part of the bladder 10.

FIG. 5 depicts a cut through of a section of the inflatable ball such that many of the features which are relevant can be seen. The general construction and layering of the majority of the core components of the invention in the second embodiment 2000 can be seen in FIG. 5.

The second embodiment of the invention is the same as the first except that the bladder no longer contains a hole 120, but instead has the electronic casing base 170 integrally formed in the bladder. In particular, the bladder 10 defines one continuous surface into which the compartment 80 of the electronics casing 20 is recessed. Therefore, the electronics casing no longer comprises a distinct flange 130 for attaching to the bladder, for example. This simplifies the design an assembly of the invention as the electronics casing base 170 and the bladder do not need to be manufactured separately and then attached. Features which are shared with the first embodiment are not discussed again in detail in this section for brevity.

The compartment 80 that is recessed into the bladder surface has the same form as described above with respect to the first embodiment. An electronics component 30 and shock absorbing layer may thus be inserted into the compartment 80 from the outside of the bladder through the opening 70.

A sealing member 50 can be used to create an airtight seal over the electronic casing opening 70. In this embodiment, the sealing member 50 in the form of an airtight layer is sealed directly to the outer surface of the bladder 160, e.g. by an adhesive, to seal around the electronic casing opening 70 and make the interior of the bladder airtight.

FIG. 6 depicts an overall image of the bladder and components to be attached to and/or inserted into it. As can be seen, the electronics casing 20, defining the compartment 80 and depicted with perforations 60, are formed as an integral part of the bladder.

Therefore, fewer attachments, seals, or connections are required which may reduce the complexity of assembly or manufacture and improve the reliability and lifespan of the inflatable ball.

Third Embodiment

Figure 7:
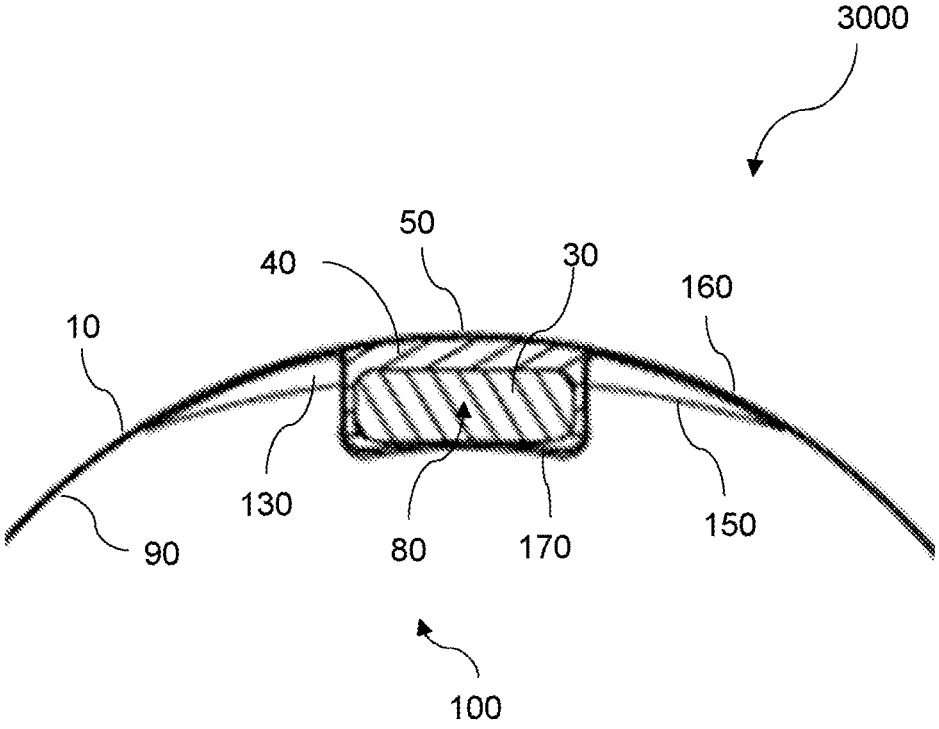
FIG. 7 shows a cut through section of the third embodiment of the invention where the electronics casing is attached to the inside of the bladder.
Figure 8:
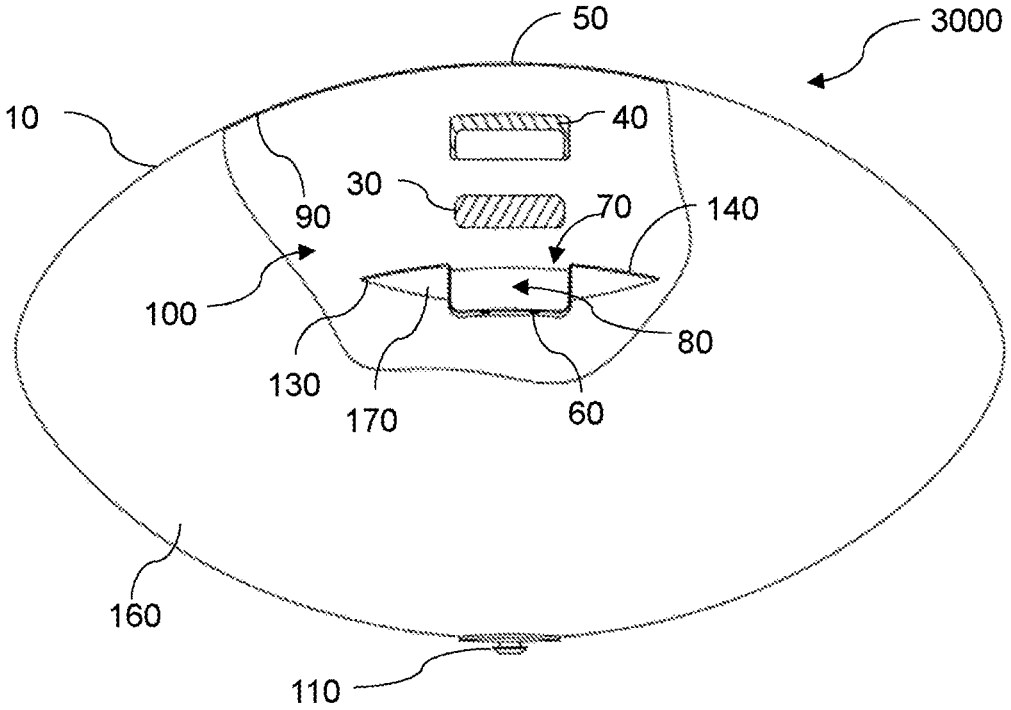
FIG. 8 shows a cut through section and overview of the inflatable ball of the third embodiment.

FIGS. 7 and 8 depict a third possible embodiment of the claimed invention. In this embodiment the electronics casing base 170 is a separate component to the bladder and is attached to the internal side 90 of the bladder.

Features which are shared with the first and second embodiment, such as the electronics casing or perforations, are not discussed again in detail in this section for brevity.

FIG. 7 depicts a cut through of a section of the third embodiment 3000 such that the majority of the features which are relevant can be seen.

FIG. 8 depicts a cut through of a section of the inflatable ball, while also providing an overall view of the inflatable ball, such that the majority of the features which are relevant can be seen.

As can be seen the electronics casing base 170 is structured similarly to that of the first embodiment. In particular, the casing base 170 comprises a recessed or concave compartment 80 with a substantially square footprint. The compartment 80 is recessed with respect to a circular flange portion 130 of the electronics casing base 170. This embodiment differs from the first embodiment in that the electronics casing base 170 is attached to the inner surface of the bladder 90, e.g. by the upper surface 140 of the flange 130. In this case, the role of the sealing member, i.e. isolating the compartment 80 from the exterior of the ball, is carried out by the inner surface of the bladder 90 to which the casing is attached. In the third embodiment, the bladder 10 takes the form and function of a typical bladder used in an inflatable ball and fully defines the inflatable interior of the ball 100 with no hole or perforation (ignore components such as valves for example). As the electronics casing base 170 allows for fluid communication with the inflatable interior of the ball 100 via perforations 60, the key features and benefits of the invention are still achieved.

The invention claimed is:

1. An inflatable ball with integrated electronics, the inflatable ball comprising:

a bladder defining an inflatable interior of the ball;

an electronics casing attached to, or integrally formed with, the bladder, the electronics casing defining a compartment adjacent an inner surface of the inflatable interior of the ball and sealed within the inflatable interior of the ball; and at least one electronic component, wherein the electronic component is located within the compartment of the electronics casing; and wherein the compartment is in fluid communication with the inflatable interior of the ball such that the compartment is at the same pressure as the inflatable interior of the ball; and wherein the electronics casing defines an electronics casing opening into the compartment for inserting the at least one electronic component, wherein the electronics casing opening faces an exterior of the bladder and is sealed by a sealing member, wherein the sealing member is an airtight layer extending over the electronics casing opening and sealed to the bladder or electronics casing, wherein prior to sealing by arrangement of the sealing member over the electronics casing opening, the electronics casing opening opens through to an exterior side of the bladder, such that the at least one electronic component may be inserted into the compartment from an exterior of the bladder; wherein the bladder contains a bladder opening for receiving the electronics casing, the electronics casing being attached to the bladder about the periphery of the bladder opening.

2. The inflatable ball according to claim 1, wherein the electronics casing is formed as one integral piece.

3. The inflatable ball according to claim 1, wherein the electronics casing is fixed relative to the bladder.

4. The inflatable ball according to claim 1, wherein the at least one electronic component is fixedly attached to the electronics casing.

5. The inflatable ball according to claim 1, wherein the electronics casing comprises one or more perforations through the electronics casing so that the compartment of the casing is in fluid communication with the inflatable interior of the ball.

6. The inflatable ball according to claim 1, wherein the electronics casing substantially encloses the at least one electronic component located in the compartment.

7. The inflatable ball according to claim 1, wherein the at least one electronic component includes at least one accelerometer, gyroscope, or force sensor.

8. The inflatable ball according to claim 1, wherein the bladder further comprises an air valve for inflating the ball, the air valve being separated from the electronics casing by an area of bladder wall.

9. The inflatable ball according to claim 1, wherein the electronics casing is made of the same material as the bladder.

10. The inflatable ball according to claim 1, wherein the electronics casing is made of material having a Young's modulus not more than 50% higher than the Young's modulus of the material forming the bladder.

* * * * *